US008372313B2

(12) United States Patent
Nakano et al.

(10) Patent No.: US 8,372,313 B2
(45) Date of Patent: Feb. 12, 2013

(54) ELECTRICAL-DISCHARGE SURFACE-TREATMENT ELECTRODE AND METAL COATING FILM FORMED USING THE SAME

(75) Inventors: Yoshikazu Nakano, Tokyo (JP); Takeshi Araki, Tokyo (JP); Akihiro Goto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 116 days.

(21) Appl. No.: 12/678,156

(22) PCT Filed: Oct. 31, 2008

(86) PCT No.: PCT/JP2008/003133

§ 371 (c)(1),
(2), (4) Date: Mar. 15, 2010

(87) PCT Pub. No.: WO2009/066418

PCT Pub. Date: May 28, 2009

(65) Prior Publication Data

US 2010/0203345 A1 Aug. 12, 2010

(30) Foreign Application Priority Data

Nov. 19, 2007 (JP) ..... 2007-299141

(51) Int. Cl.

| | |
|---|---|
| ***H01B 1/02*** | (2006.01) |
| ***H01B 1/22*** | (2006.01) |
| ***H05F 3/00*** | (2006.01) |
| ***H01T 14/00*** | (2006.01) |
| ***H05H 1/48*** | (2006.01) |

(52) U.S. Cl. ..... 252/512; 304/164; 427/580

(58) Field of Classification Search ..... 252/500, 252/512; 204/164; 427/580

See application file for complete search history.

(56) References Cited

U.S. PATENT DOCUMENTS

| | | | | |
|---|---|---|---|---|
| 6,265,105 | B1 * | 7/2001 | Tokuda et al. | 429/206 |
| 2005/0048362 | A1 * | 3/2005 | Coffey et al. | 429/161 |
| 2005/0048364 | A1 * | 3/2005 | Coffey et al. | 429/163 |
| 2006/0021868 | A1 * | 2/2006 | Goto et al. | 204/164 |
| 2006/0081462 | A1 | 4/2006 | Goto et al. | |
| 2006/0093909 | A1 * | 5/2006 | Zhang | 429/209 |

FOREIGN PATENT DOCUMENTS

| | | | |
|---|---|---|---|
| JP | 60037655 | A * | 2/1985 |
| JP | 61-33819 | A | 2/1986 |
| JP | 62022369 | A * | 1/1987 |
| JP | 2000-42836 | A | 2/2000 |
| JP | 2000 106167 | | 4/2000 |
| JP | 2006 124742 | | 5/2006 |
| JP | 2007 026786 | | 2/2007 |
| JP | 2007 070712 | | 3/2007 |
| WO | 2004 108989 | | 12/2004 |

OTHER PUBLICATIONS

Office Action issued May 29, 2012 in Japanese Patent Application No. 2009-542464 (with English-language translation).

* cited by examiner

*Primary Examiner* — Harold Pyon
*Assistant Examiner* — Tanisha Diggs
(74) *Attorney, Agent, or Firm* — Oblon, Spivak, McClelland, Maier & Neustadt, L.L.P.

(57) ABSTRACT

An objective is to provide an electrical-discharge surface-treatment electrode by which a high-coverage zinc coating film can be formed. The electrical-discharge surface-treatment electrode is made by uniformly distributing and compression-molding zinc-based powders including at least one of a pure-metal zinc powder and a metal zinc powder whose surface is oxidized, and zinc-oxide powders whose content rate ranges from 5 to 90 volume percent with respect to the zinc-based powders, to obtain a porosity ranging from 10 to 55 volume percent; then, the zinc coating film is formed using the electrical-discharge surface-treatment electrode.

5 Claims, 5 Drawing Sheets

ELECTRICAL-DISCHARGE SURFACE-TREATMENT ELECTRODE AND METAL COATING FILM FORMED USING THE SAME

This is an application filed under 35 U.S.C. 371 of PCT/JP2008/003133 filed Oct. 31, 2008, which claims priority from Japan 2007-299141, filed Nov. 19, 2007.

TECHNICAL FIELD

The present invention relates to an electrical-conductive electrode, used for electrical-discharge surface treatment, by which pulsed electrical discharge is generated between the electrode and a target to be processed, and due to this pulsed electrical-discharge energy, a coating film composed of that electrode material or reacted material obtained, by the electrical-discharge energy, from the electrode material is formed on the surface of the target.

BACKGROUND ART

Due to forming of an abrasion-resistant coating film on the surface of a target to be processed by electrical-discharge surface treatment, abrasion resistance and slidability thereof can be improved. For example, a method has been disclosed in which a zinc coating film is sparsely formed on the surface of a target to be processed by using as an electrode a powder compact formed by zinc metal powders, and generating pulsed electrical discharge between this electrode and a target to be processed, so as to enable a crack-free coating film to be formed (for example, refer to Patent Document 1). Another electrical-discharge surface-treatment electrode has been disclosed in which characteristics of the electrode strength and the electrical resistivity thereof are improved by mixing electrical insulating organic binder of high plasticity, electrical-conductive organic powders of low plasticity, and zinc powders (for example, refer to Patent Document 2).

[Patent document 1]

Japanese Patent Application Publication Laid-Open No. 2006-124742 (page 3, FIG. 8)

[Patent document 2]

Japanese Patent Application Publication Laid-Open No. 2007-70712 (page 11, FIG. 4)

DISCLOSURE OF THE INVENTION

Problems to be Solved by the Invention

The electrical discharge between the electrical-discharge surface-treatment electrode and the target to be processed is an arc discharge type, in which the central temperature of the arc column reaches 2000 K-8000 K. Even though the zinc coating film is formed using the electrical-discharge surface-treatment electrode configured of the conventional metal-zinc powders, because the melting point of zinc is low, the zinc material comes into a melting or a vaporizing state during forming of the coating film and the zinc material does not adhere to the target in the vicinity of the center of the arc column, and due to the zinc material adhering only in the periphery of the arc column, a sparse coating film is obtained; therefore, a problem has been that high coverage cannot be achieved. Accordingly, durability that the zinc coating film basically possesses has not been sufficiently ensured.

An objective of the present invention, which is made to solve the above described problem, is to provide an electrical-discharge surface-treatment electrode by which a high-coverage coating film of low-melting-point metal such as zinc can be formed.

Means for Solving the Problem

In an electrical-discharge surface-treatment electrode according to an aspect of the present invention, low-melting-point metal-based powders including at least one of a low-melting-point metal powder being pure metal and a low-melting-point metal powder whose surface is oxidized, and oxidized powders of this low-melting-point metal are included; and the low-melting-point metal-based powders and the oxidized powders are uniformly distributed and compression-molded.

In an electrical-discharge surface-treatment electrode according to another aspect of the present invention, zinc-based powders including at least one of a pure-metal zinc powder and a metal zinc powder whose surface is oxidized, and zinc-oxide powders from 5 to 90 volume % with respect to the zinc-based powders are included; and the zinc-based powders and the zinc-oxide powders are uniformly distributed and compression-molded to obtain a porosity ranging from 10 to 55 volume %.

In an electrical-discharge surface-treatment electrode according to another aspect of the present invention, aluminum-based powders including at least one of a pure aluminum powder and an aluminum powder whose surface is oxidized, and aluminum-oxide powders from 5 to 70 volume % with respect to the aluminum-based powders are included; and the aluminum-based powders and the aluminum-oxide powders are uniformly distributed and compression-molded to obtain a porosity ranging from 10 to 50 volume %.

Advantageous Effect of the Invention

According to the present invention, to the pure-metal low-melting-point metal powder, the metal-oxide powder, of the same low-melting-point metal, whose melting point is higher than the low-melting-point metal powder is added, whereby the metal coating film is formed by the reduction of the metal-oxide substance in the vicinity of the arc column, so that the high-coverage metal coating film can be obtained.

EXPLANATION OF REFERENCES

Figure 1:
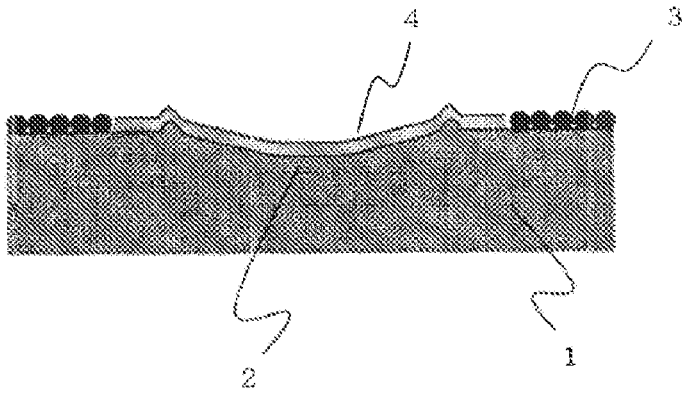
FIG. 1 is a cross-sectional schematic view of a zinc coating film in Embodiment 1 for carrying out the invention.

1. Substrate
2. Electrical discharged trace
3. Zinc particle
4. Zinc layer

BEST MODE FOR CARRYING OUT THE INVENTION

Embodiment 1

An electrical-discharge surface-treatment electrode according to Embodiment 1 of the present invention was manufactured by the following processes. 7.0 g of pure metal zinc powders whose average particle diameter is approximately 3 micro-m, and 5.6 g of zinc oxide powders whose average particle diameter is approximately 0.5 micro-m were homogeneously mixed, for example, using a V-type mixer, and then the mixed powders were pressure molded at a predetermined pressure, whereby a cylindrical electrical-discharge surface-treatment electrode whose diameter is approximately 10 mm and whose height is approximately 25 mm was formed. In the electrical-discharge surface-treatment electrode according to this embodiment, the porosity is 20 volume %, and the amount of the zinc oxide powders is 50 volume % with respect to that of the pure metal zinc powders.

By applying a pulsed voltage whose open circuit voltage is approximately 300 V and whose frequency is approximately 200 kHz, between the cylindrical electrical-discharge surface-treatment electrode according to this embodiment and a chromium-molybdenum-steel substrate as the target, pulsed electrical discharge was generated, whereby a zinc coating film was formed on the surface of the substrate. The zinc coating film formed on the surface of the substrate has a circular shape whose diameter is approximately 10 mm which is approximately the same as that of the cross-section of the cylindrical electrode.

FIG. 1 is a cross-sectional schematic view of the zinc coating film formed by using the electrical-discharge surface-treatment electrode according to this embodiment. On the surface of a substrate 1, an electrical discharged trace 2 is formed caused by melting of a part of the substrate due to the electrical discharge, and zinc particles 3 that are the pure metal zinc of the electrode material having moved and attached to the substrate side are deposited on the periphery of the electrical discharged trace 2. On the surface of the electrical discharged trace 2, a zinc layer 4 is formed. It is presumed that the reason for this zinc layer 4 being formed is as follows. Because the melting point of zinc oxide is higher than that of chromium molybdenum used as the substrate, when electric discharge generates between the electrode and the substrate, in a region where the electrical discharged trace 2 is formed, the temperature reaches in a range in which zinc oxide does not melt but the substrate melts. In this temperature range, metal zinc evaporates off, while zinc oxide attaches to the substrate. Under the temperature circumstance just after the attachment, this zinc oxide is reduced to metal zinc by decomposed carbon from machine oil or chromium as a component element of the substrate. The reason is that, because chromium is easy to be oxidized compared with zinc, and the reduction reaction at this stage is endothermic, the temperature of the portion in the vicinity of the electrical discharged trace 2 where the zinc oxide is attached decreases to a degree at which metal zinc does not vaporize. It is presumed that the zinc layer 4 is formed by such a mechanism.

As described above, by forming the zinc coating film using the electrical-discharge surface-treatment electrode according to this embodiment, a zinc layer can be also formed on the electrical discharged trace; therefore, a high-coverage zinc coating film can be formed.

Here, in this embodiment, the chromium-molybdenum steel is used as the substrate; however, other substrates such as alloy tool steel referred to as SKS or SKD, high-speed tool steel referred to as SKH, nickel-chromium-molybdenum steel referred to as SNCM, and chromium steel referred to as SCR can also be used.

In this embodiment, the pure metal zinc powders are used; however, a case may occur that the surface of the pure metal zinc powders has been oxidized. Even if such powders are used, similar effect can also be obtained. Hereinafter, powders including at least one of the pure metal zinc powder and the metal zinc powder whose surface has been oxidized are referred to as zinc-based powders.

Embodiment 2

In an electrical-discharge surface-treatment electrode according to Embodiment 2, the mixing ratio between the zinc-based powders and the zinc-oxide powders is varied. The manufacturing method of the electrical-discharge surface-treatment electrode is similar to that in Embodiment 1, in which the porosity was set to 20 volume %. Electrical-discharge surface-treatment electrodes were made in which the composition ratio (volume %) of the zinc-oxide powders is varied with respect to the zinc-based powders, and a zinc coating films were formed on the surface of the chromium-molybdenum-steel substrate similarly to that in Embodiment 1; then, the zinc coverage of each coating film was measured. The zinc coverage (area %) was obtained, by area-analyzing a coating-film region of 100×100 micro-m using an electron probe micro analyzer, from the area ratio of a region where zinc reaction is detected with respect to the analyzed region.

Figure 2:
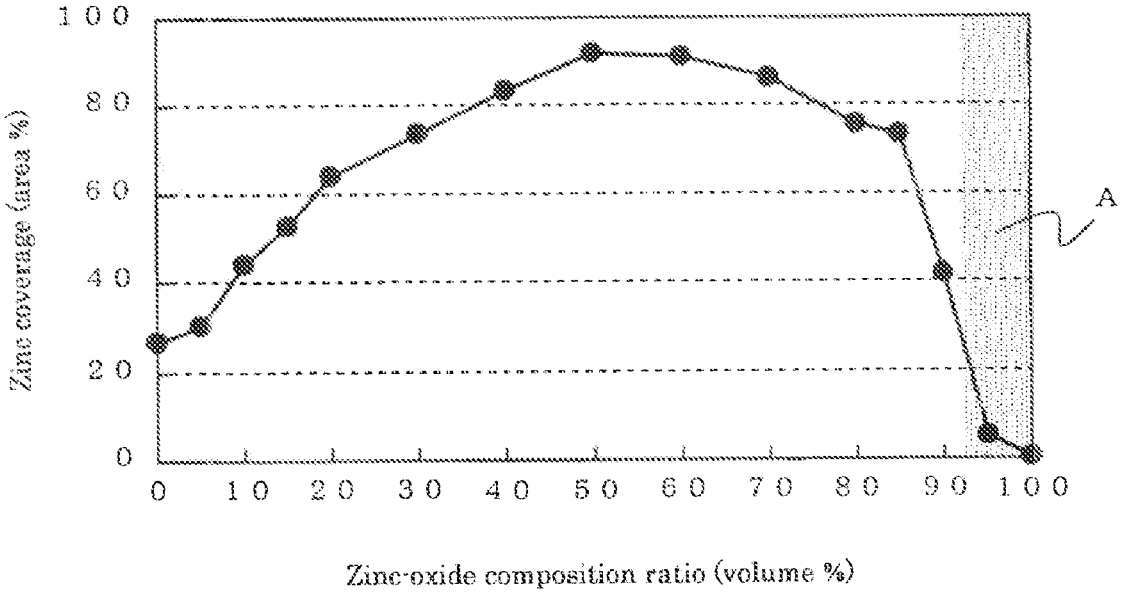
FIG. 2 is a characteristic graph of a zinc coating film in Embodiment 2 for carrying out the invention.

FIG. 2 is a characteristic graph representing a relationship between the zinc-oxide composition ratio (volume %) of the electrode and the zinc coverage (area %) of the coating film according to this embodiment. A case where the value of the horizontal axis is 0 volume % represents that in which the electrical-discharge surface-treatment electrode is formed only of the zinc-based powders, while a case where the value of the horizontal axis is 100 volume % represents that in which the electrical-discharge surface-treatment electrode is formed only of the zinc-oxide powders. As seen from FIG. 2, when the amount of the zinc-oxide powders is not smaller than 5 volume % with respect to that of the zinc-based powders, the coverage becomes higher than that (0 volume % in FIG. 2) of the zinc coating film formed using the conventional electrical-discharge surface-treatment electrode formed only of the zinc-based powders. Especially, when the zinc-oxide composition ratio is 50 volume %, a high coverage of approximately 90 area %, which cannot have been obtained, can be realized.

In a shaded portion A, of FIG. 2, where the zinc-oxide composition ratio exceeds 90 volume %, because the electrical resistivity of the electrode becomes not lower than 100 ohm-cm, which is an extremely high level, the electrical discharge in forming the film becomes unstable, and the coverage significantly decreases. As a result, the zinc coating film whose coverage is higher than that of the conventional one can be obtained in a range from 5 volume % to 90 volume % of the zinc-oxide powders with respect to the zinc-based powders. Moreover, the ratio is preferable in a range from 10 volume % to 90 volume %, where the zinc coverage is not lower than 40 area %.

Here, in this embodiment, the porosity is set to a constant value of 20 volume %; however, a similar effect can be obtained even in a range from 10 to 55 volume % of the porosity, and a high-coverage zinc coating film can be obtained in a range from 5 to 90 volume % of the zinc-oxide-powder composition ratio.

Embodiment 3

Regarding an electrical-discharge surface-treatment electrode according to Embodiment 3, the average particle diameter of the zinc-based powders is varied. The average particle diameter of the zinc-based powders was varied in a range from 1.5 to 8 micro-m. Pure metal zinc powders whose surfaces are oxidized were used as the zinc-based powders. The manufacturing method of the electrical-discharge surface-treatment electrode was similar to that in Embodiment 1, in which the average particle diameter of the zinc-oxide powders used is 0.5 micro-m, the porosity is set to 20 volume %, and the zinc-oxide-powder composition ratio (volume %) with respect to the zinc-based powders is set to a constant value of 50 volume %. Moreover, a zinc coating film was formed on the surface of the chromium-molybdenum-steel substrate in a manner similar to that in Embodiment 1; then, the zinc coverage of the coating film was measured.

Figure 3:
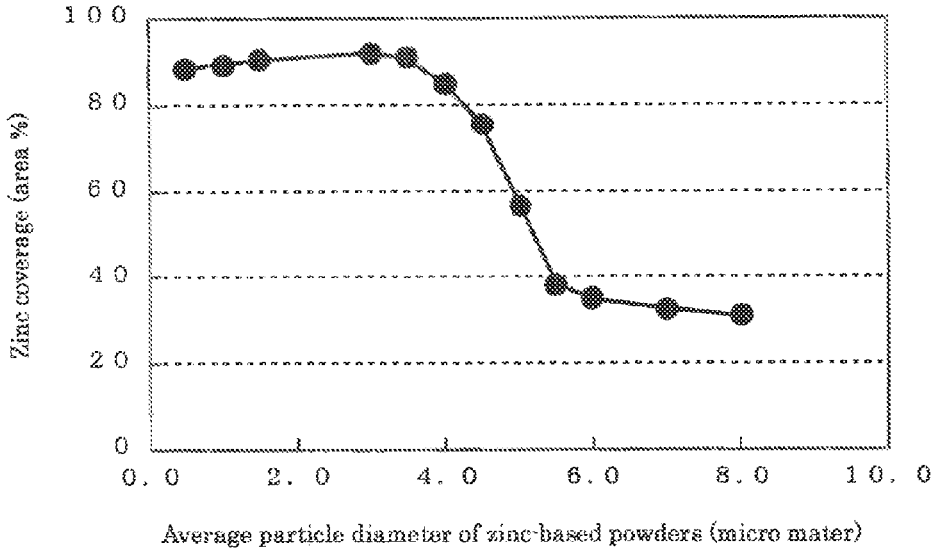
FIG. 3 is a characteristic graph of a zinc coating film in Embodiment 3 for carrying out the invention.

FIG. 3 is a characteristic graph representing a relationship between the average particle diameter of the zinc-based powders for the electrode and the zinc coverage (area %) of the coating film according to this embodiment. In a range of the average particle diameter of the zinc-based powders being not larger than 5.0 micro-m, the zinc coverage of the coating film is not lower than 50 area %. When the average particle diameter of the zinc-based powders exceeds 5.0 micro-m, because the gap between the tip of the electrical-discharge surface-treatment electrode and the surface of the substrate does not stay constant during discharging, the discharging becomes unstable, and unevenness becomes easy to occur in the coating film, the zinc coverage decreases; however, the zinc coverage is not lower than 30 area %, which is higher than that of the zinc coating film formed using the conventional electrical-discharge surface-treatment electrode made only of the zinc-based powders (at 0 volume % of the zinc-oxide composition ratio in FIG. 2 according to Embodiment 2). Here, because the smaller the average particle diameter of the zinc-based powders, the more easily the powders are oxidized, in a region where the average particle diameter of the zinc-based powders is not larger than 3.0 micro-m, the electrical resistance of the electrode increases due to the effect, and the electrical discharge becomes a little more likely to be unstable; therefore, the zinc coverage tends to decrease.

Here, in this embodiment, the zinc-oxide powders whose average particle diameter is 0.5 micro-m were used; however, a similar result was obtained also in a case of the zinc-oxide powders whose average particle diameter is from 0.2 to 5 micro-m being used; accordingly, in a condition in which the average particle diameter of the zinc-based powders is not larger than 5.0 micro-m, the zinc coating film whose zinc coverage is not lower than 50 area % was obtained.

Embodiment 4

Regarding an electrical-discharge surface-treatment electrode according to Embodiment 4, the porosity is varied on the condition that the composition ratio of the zinc-oxide powders is set to 50 volume % with respect to the zinc-based powders. The manufacturing method of the electrical-discharge surface-treatment electrode was similar to that in Embodiment 1, in which the porosity was varied by controlling pressing pressure during pressure-molding. The porosity of the electrical-discharge surface-treatment electrode made in this embodiment is in a range from 5 to 55 volume %. Moreover, using the electrical-discharge surface-treatment electrode made while varying the porosity, a zinc coating film was formed on the surface of the chromium-molybdenum-steel substrate in a manner similar to that in Embodiment 1; then, the zinc coverage was measured.

Figure 4:
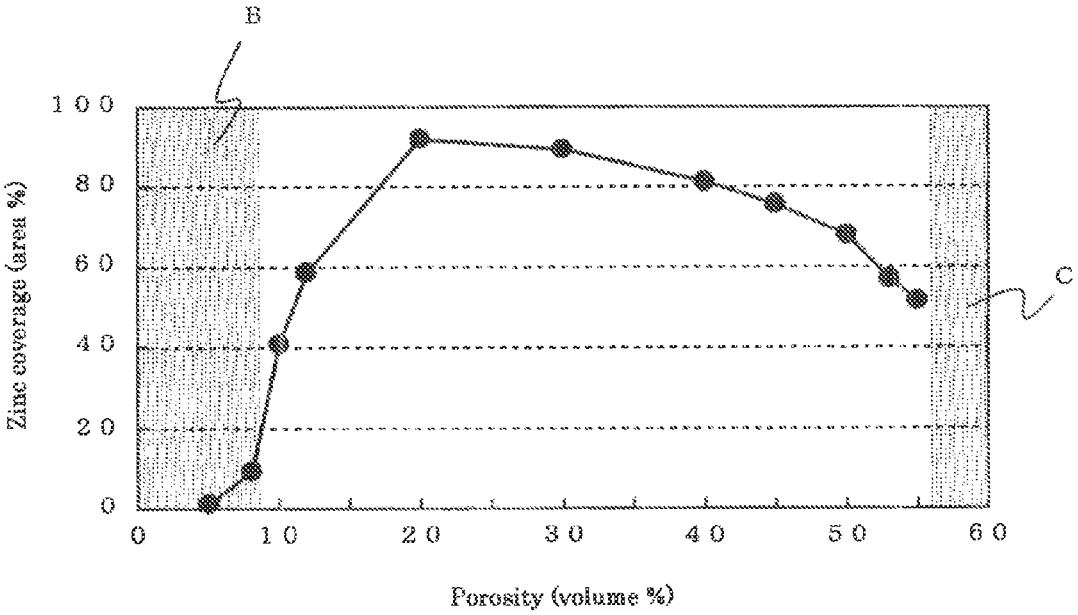
FIG. 4 is a characteristic graph of a zinc coating film in Embodiment 4 for carrying out the invention.

FIG. 4 is a characteristic graph representing a relationship between the porosity (volume %) of the electrode and the zinc coverage (area %) of the coating film according to this embodiment. In a shaded portion B where the porosity is smaller than 10 volume %, because the electric discharge during forming of the film becomes unstable, the coverage extremely decreases. While, in a shaded portion C where the porosity exceeds 55 volume %, because the porosity is too high, it becomes difficult to maintain the shape of the electrical-discharge surface-treatment electrode; accordingly, it becomes difficult to use it. As seen from FIG. 4, when the porosity is in a range from 10 volume % to 55 volume %, the coverage becomes higher than that of the zinc film formed using the electrical-discharge surface-treatment electrode made of only the conventional zinc-based powders.

Here, in this embodiment, although the composition ratio of the zinc-oxide powders is set to a constant of 50 volume %, a similar effect can also be obtained in a range from 5 to 90 volume % of the composition ratio, and a high-coverage zinc film can be obtained in the range from 10 to 55 volume % of the porosity.

Embodiment 5

Regarding an electrical-discharge surface-treatment electrode according to Embodiment 5, the average particle diameter of the zinc-oxide powders is varied while the average particle diameter of the zinc-based powders is 3 micro-m. The average particle diameter of the zinc-oxide powders was varied in a range from 0.05 to 20 micro-m. Here, the composition ratio of the zinc-oxide powders was set to a constant of 50 volume % with respect to the zinc-based powders. The manufacturing method of the electrical-discharge surface-treatment electrode was similar to that in Embodiment 1, in which the porosity was set to a constant of 20 volume % by controlling pressing pressure during the pressure molding. Moreover, using the electrode made while varying the average particle diameter of these zinc-oxide powders, a zinc coating film was formed on the surface of the chromium-molybdenum-steel substrate in a manner similar to that in Embodiment 1; then, the zinc coverage was measured.

Figure 5:
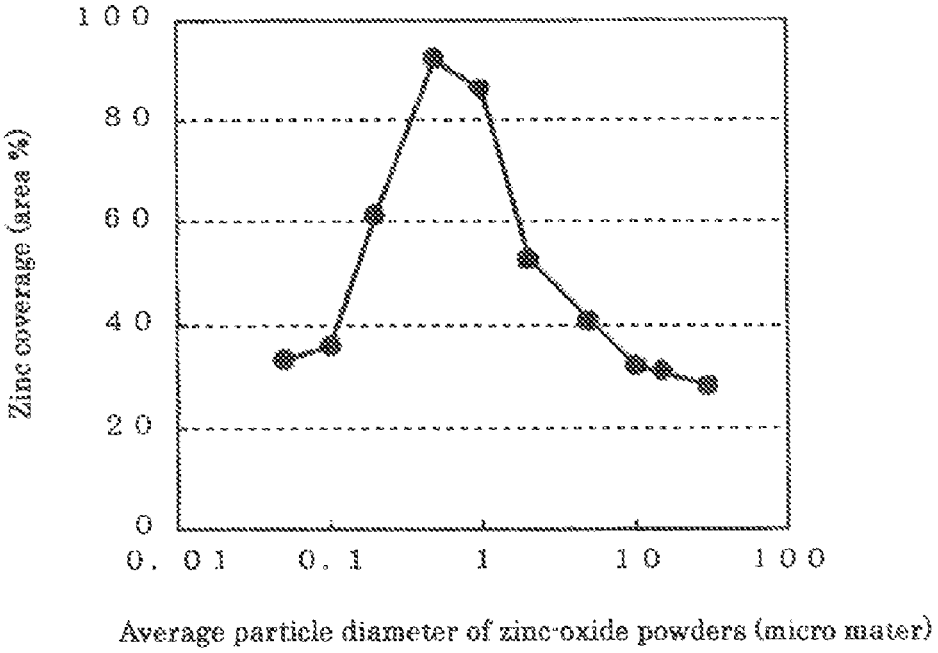
FIG. 5 is a characteristic graph of a zinc coating film in Embodiment 5 for carrying out the invention.

FIG. 5 is a characteristic graph representing a relationship between the average particle diameter (micro-m) of the electrode zinc-oxide powders and the zinc coverage (area %) of the coating film according to this embodiment. As seen from FIG. 5, by setting the average particle diameter of the zinc-oxide powders to a value not larger than 5 micro-m, the zinc-oxide powders are sufficiently melted in discharging, and due to sufficient growth of a zinc layer in a region of the electrical discharged trace, a high zinc coverage can be obtained. Moreover, because, by setting the average particle diameter of the zinc-oxide powders to a value not smaller than 0.2 micro-m, due to decrease of the contact resistance of the zinc-based powders and the zinc-oxide powders, electrical conductivity of the electrical-discharge surface-treatment electrode is improved, the electrical discharge is stabilized; therefore, a high zinc coverage can be ensured.

Here, in this embodiment, although the porosity of the electrical-discharge surface-treatment electrode is set to a constant of 20 volume %, a similar effect can also be obtained in a range from 10 to 55 volume % of the porosity Moreover, the zinc-based powders whose average particle diameter is 3 micro-m were used; however, a similar effect can also be obtained even if the zinc-based powders whose average particle diameter is not larger than 5 micro-m are used.

Embodiment 6

Regarding an electrical-discharge surface-treatment electrode according to Embodiment 6, zinc-oxide powders to which 0.5 weight % of aluminum is added are used as the zinc-oxide powders to be raw material. The average particle diameter of the zinc-oxide powders to which aluminum is added was varied in a range from 0.05 to 20 micro-m while the average particle diameter of the zinc-based powders is 3 micro-m. The manufacturing method of the electrical-discharge surface-treatment electrode was similar to that in Embodiment 5, in which the porosity was set to a constant of 20 volume %.

Figure 6:
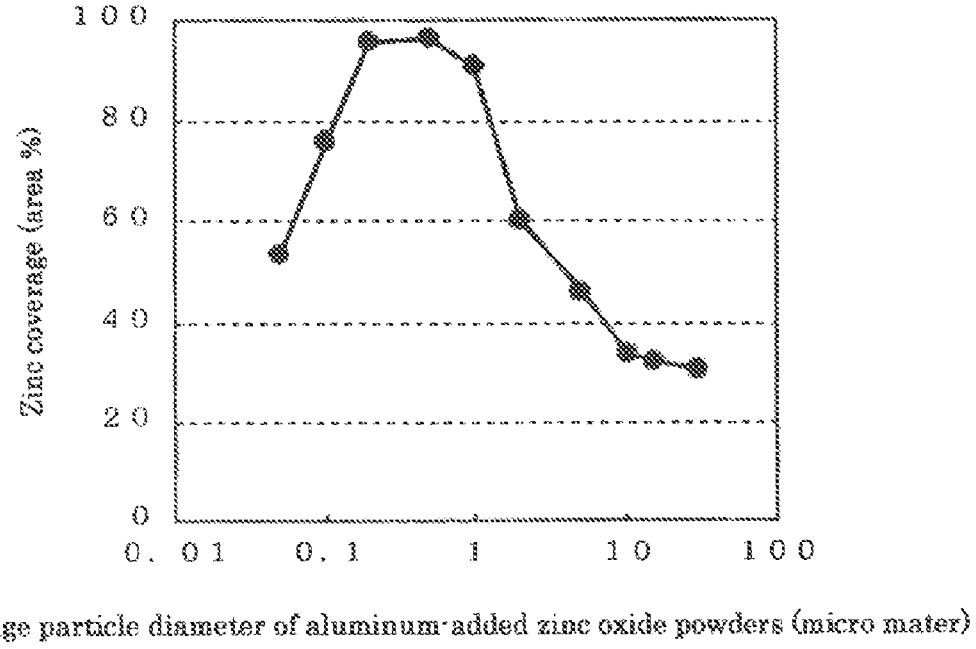
FIG. 6 is a characteristic graph of a zinc coating film in Embodiment 6 for carrying out the invention.

FIG. 6 is a characteristic graph representing a relationship between the average particle diameter (micro-m) of the zinc-oxide powders to which aluminum is added and the zinc coverage (area %), according to this embodiment. As seen from FIG. 6, because aluminum is added to the zinc-oxide powders, electrical conductivity of the electrical-discharge surface-treatment electrode is improved, the electrical discharge is stabilized, and a higher zinc coverage can be ensured in a range from 0.05 to 5 micro-m of the average particle diameter of the zinc-oxide powders. In a case of the average particle diameter of the zinc-oxide powders being not smaller than 5 micro-m, because the gap between the tip of the electrical-discharge surface-treatment electrode and the surface of the substrate does not stay constant during discharging, the discharging becomes unstable, and the zinc coating film becomes difficult to be formed.

Here, in this embodiment, although the zinc-oxide powders to which 0.5 weight % of aluminum is added were used as the zinc-oxide powders, the invention is not limited to this amount; that is, if the additive amount is in a range from 0.1 to 5 weight %, the amount of aluminum mixed to the zinc coating film would not deteriorate characteristics as the zinc coating film.

Furthermore, in this embodiment, although the zinc-oxide powders to which aluminum is added were used, boron or germanium, etc., by which electrical conductivity of the electrical-discharge surface-treatment electrode is improved, can be used as the additive metal.

Embodiment 7

Regarding an electrical-discharge surface-treatment electrode according to Embodiment 7, aluminum is selected as low-melting-point metal, and the mixing ratio between aluminum powders and aluminum-oxide powders is varied similarly to that in Embodiment 2 in which zinc is used. The manufacturing method of the electrical-discharge surface-treatment electrode was similar to that in Embodiment 1, in which the porosity is set to 20 volume %. The electrical-discharge surface-treatment electrode was made in which the composition ratio (volume %) of the aluminum-oxide powders is varied with respect to the aluminum powders, and an aluminum coating film was formed on the surface of a carbon steel substrate for machine structural use (for example, SC material); then, the aluminum coverage of this coating film was measured. The measurement method of the aluminum coverage (area %) is similar to that in Embodiment 2.

Figure 7:
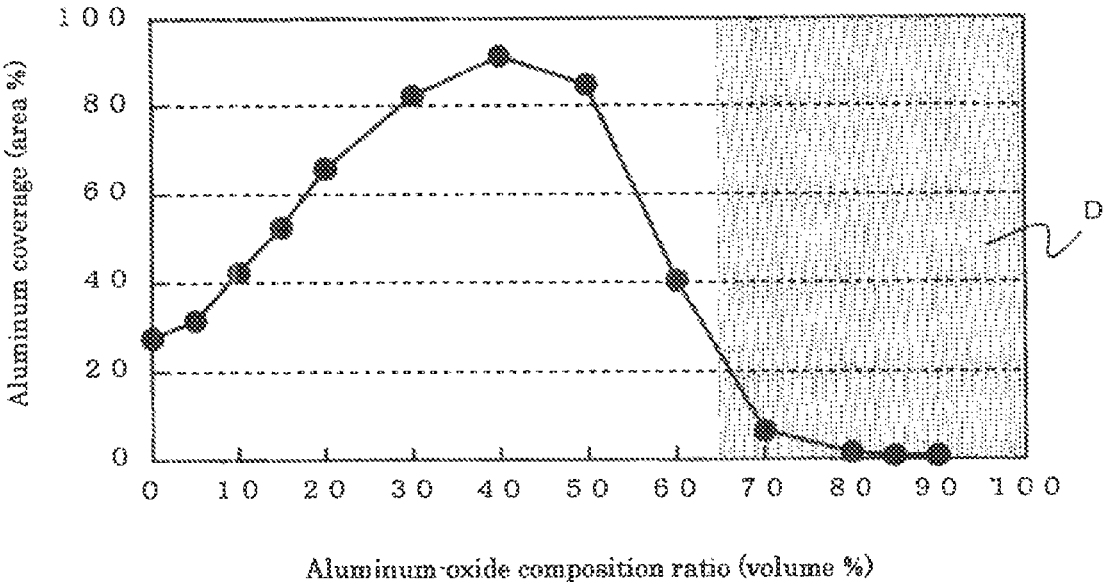
FIG. 7 is a characteristic graph of an aluminum coating film in Embodiment 7 for carrying out the invention.

FIG. 7 is a characteristic graph representing a relationship between the aluminum-oxide composition ratio (volume %) of the electrode and the aluminum coverage (area %) of the coating film according to this embodiment. A case where the value of the horizontal axis is 0 volume % represents that in which the electrical-discharge surface-treatment electrode is formed only of the aluminum powders, while a case where the value is 100 volume % represents that in which the electrical-discharge surface-treatment electrode is formed only of the aluminum-oxide powders. As seen from FIG. 7, if the amount of the aluminum-oxide powders is not smaller than 5 volume % with respect to that of the aluminum powders, the coverage becomes higher than that of the aluminum coating film (0 volume % in FIG. 7) formed using the conventional electrical-discharge surface-treatment electrode formed only of the aluminum powders. Especially, when the composition ratio of the aluminum-oxide powders is 40 volume %, a high coverage of approximately 90 area %, which has never been obtained before, can be realized.

In a shaded region D where the aluminum-oxide composition ratio in FIG. 7 exceeds 70 volume %, because the electrical resistivity of the electrode extremely increases to be not lower than 100 ohm-cm, discharging during forming of the film becomes unstable; accordingly, the coverage extremely decreases. As a result, in a range from 5 volume % to 70 volume % of the aluminum-oxide-powder ratio with respect to the aluminum one, an aluminum coating film having a value of the coverage higher than the conventional one can be obtained. Specifically, its preferable range is from 10 volume % to 60 volume %, where the aluminum coverage is not lower than 40 area %.

Here, in this embodiment, although the porosity is set to a constant of 20 volume %, a similar effect can also be obtained in a range from 10 to 50 volume % of the porosity, and a high-coverage aluminum coating film can be obtained in a range from 5 to 70 volume % of the composition ratio of the aluminum-oxide powders.

Embodiment 8

Regarding an electrical-discharge surface-treatment electrode according to Embodiment 8, the average particle diameter of aluminum powders is varied. The average particle diameter of the aluminum powders was varied in a range from 0.5 to 5 micro-m. Pure metal aluminum powders whose surfaces are oxidized were used as the aluminum powders. The manufacturing method of the electrical-discharge surface-treatment electrode was similar to that in Embodiment 1, in which the average particle diameter of the aluminum-oxide powders is 0.5 micro-m, the porosity is set to 20 volume %, and the composition ratio (volume %) of the aluminum-oxide powders with respect to the aluminum-based powders is set to a constant of 40 volume %. Moreover, an aluminum coating film was formed on the surface of carbon steel substrate for machine structural use (for example, SC material) in a manner similar to that in Embodiment 7; then, the aluminum coverage of this coating film was measured.

Figure 8:
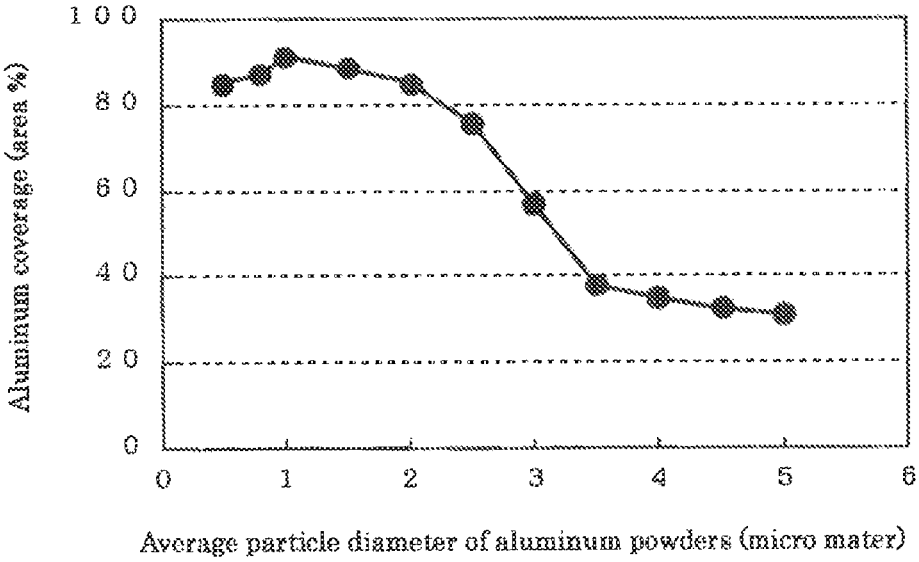
FIG. 8 is a characteristic graph of an aluminum coating film in Embodiment 8 for carrying out the invention.

FIG. 8 is a characteristic graph representing a relationship between the average particle diameter of the aluminum powders of the electrode and the aluminum coverage (area %) of the coating film, according to this embodiment. The aluminum coverage of the coating film becomes not less than 50 area % in a range not larger than 3.0 micro-m of the average particle diameter of the aluminum powders. In a case of the average particle diameter of the aluminum powders exceeding 3.0 micro-m, because the gap between the tip of the electrical-discharge surface-treatment electrode and the surface of the substrate does not stay constant during discharging, the discharging becomes unstable, and unevenness easily occurs in the coating film, the aluminum coverage decreases; however, the aluminum coverage is not lower than 30 area %, which is higher than that (at 0 volume % of the aluminum-oxide composition ratio in FIG. 7 according to Embodiment 7) of the aluminum coating film formed using the conventional electrical-discharge surface-treatment electrode made only of the aluminum powders. Here, because the smaller the average particle diameter of the aluminum powders, the more easily the powders are oxidized, in a region where the average particle diameter of the aluminum powders is not larger than 1.0 micro-m, the electrical resistance of the electrode increases due to that effect, and the electrical discharge becomes a little more likely to be unstable; therefore, the aluminum coverage tends to decrease.

Here, in this embodiment, although the aluminum powders having their average particle diameter of 0.5 micro-m were used, a similar result can also be obtained even in a case of using the aluminum-oxide powders having their average particle diameter in a range from 0.2 to 2 micro-m, and, in a range not larger than 3.0 micro-m of the average particle diameter of the aluminum powders, an aluminum coating film having its aluminum coverage not lower than 50 area % was obtained.

Embodiment 9

Regarding an electrical-discharge surface-treatment electrode according to Embodiment 9, the porosity is varied on the condition that the composition ratio of the aluminum-oxide powders is set to 40 volume % with respect to the aluminum powders. The manufacturing method of the electrical-discharge surface-treatment electrode was similar to that in Embodiment 1, in which, the porosity was varied by controlling pressing pressure during pressure molding. The porosity of the electrical-discharge surface-treatment electrode made in this embodiment is in a range from 5 to 50 volume %. Then, using the electrical-discharge surface-treatment electrode made while varying the porosity, an aluminum coating film was formed on the surface of SC material substrate in a manner similar to that in Embodiment 7; then, the aluminum coverage of this coating film was measured.

Figure 9:
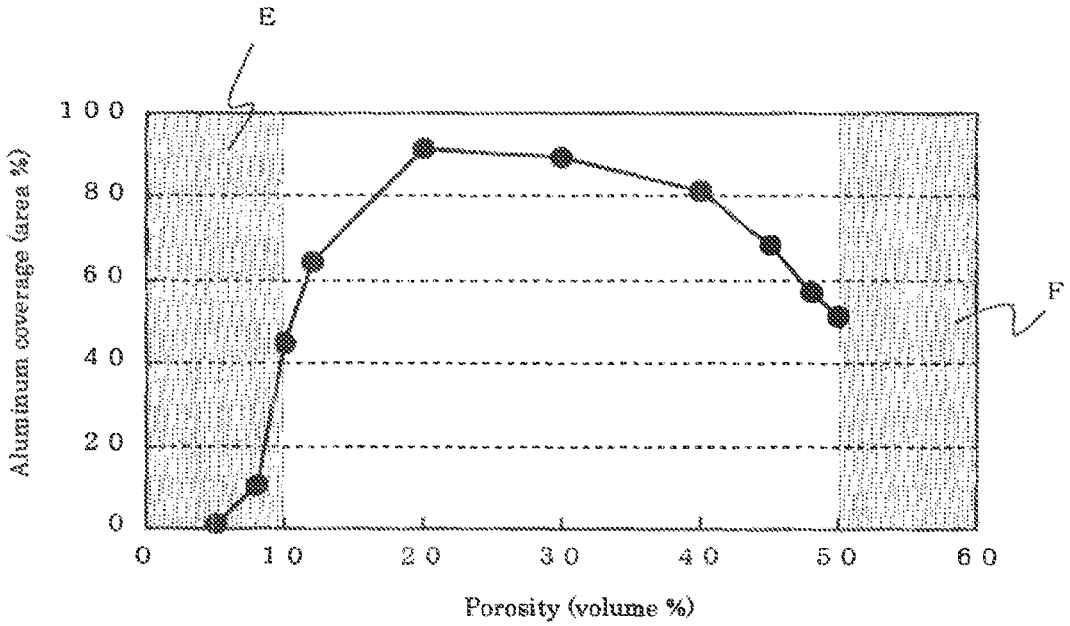
FIG. 9 is a characteristic graph of an aluminum coating film in Embodiment 9 for carrying out the invention.

FIG. 9 is a characteristic graph representing a relationship between the porosity (volume %) of the electrode and the aluminum coverage (area %) of the coating film, according to this embodiment. In a shaded area E where the porosity is lower than 10 volume %, discharging becomes unstable during forming of the film, and the coverage extremely decreases. While, in a shaded area F where the porosity exceeds 50 volume %, because the porosity is too high, it becomes difficult to keep the shape of the electrical-discharge surface-treatment electrode, and it becomes difficult to use. As seen from FIG. 9, if the porosity is from 10 volume % to 50 volume %, the coverage becomes higher than that of the aluminum coating film formed using the conventional electrical-discharge surface-treatment electrode made only of the aluminum powders.

Here, in this embodiment, although the composition ratio of the aluminum-oxide powders is set to a constant of 40 volume %, a similar effect can also be obtained in a range from 5 to 70 volume % of the composition ratio, and a high-coverage aluminum coating film can be obtained in a range from 10 to 50 volume % of the porosity.

Embodiment 10

Regarding an electrical-discharge surface-treatment electrode according to Embodiment 10, the average particle diameter of aluminum-oxide powders is varied while the average particle diameter of the aluminum powders is 1 micro-m. The average particle diameter of the aluminum-oxide powders was varied in a range from 0.5 to 5 micro-m. Here, the composition ratio of the aluminum-oxide powders was set to a constant of 40 volume % with respect to the aluminum powders. The manufacturing method of the electrical-discharge surface-treatment electrode was similar to that in Embodiment 1, in which pressing pressure during pressure molding was controlled so that the porosity becomes a constant of 20 volume %. Moreover, using the electrical-discharge surface-treatment electrode made while varying the average particle diameter of these aluminum-oxide powders, an aluminum coating film was formed on the surface of SC material substrate in a manner similar to that in Embodiment 7; then, the aluminum coverage was measured.

Figure 10:
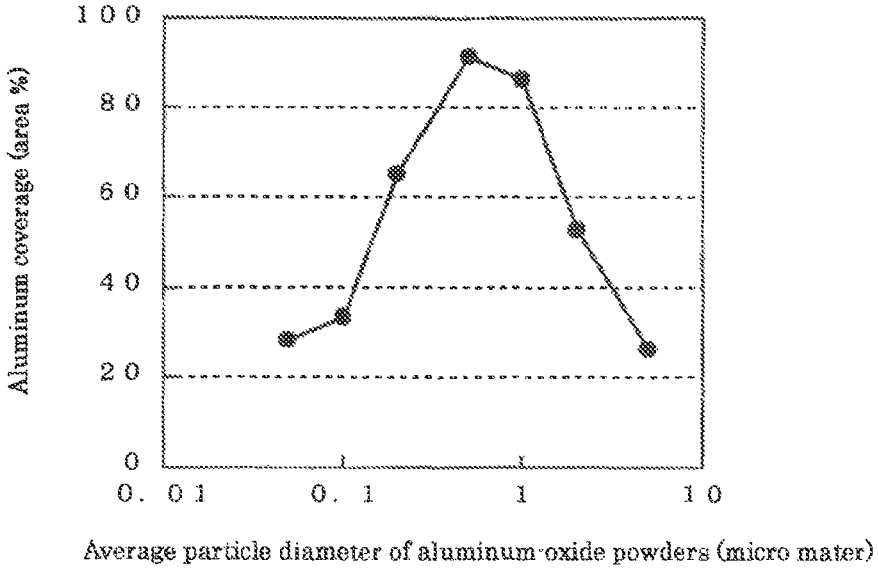
FIG. 10 is a characteristic graph of an aluminum coating film in Embodiment 10 for carrying out the invention.

FIG. 10 is a characteristic graph representing a relationship between the average particle diameter (micro-m) of the aluminum-oxide powders of the electrode and the aluminum coverage (area %) of the coating film, according to this embodiment. As seen from FIG. 10, by setting the average particle diameter of the aluminum-oxide powders to a value not larger than 2 micro-m, aluminum-oxide is sufficiently melted in discharging; thereby, due to sufficient growth of an aluminum layer in an electrical-discharged-trace region, a high aluminum coverage can be obtained. Moreover, because, by setting the average particle diameter of the aluminum-oxide powders to a value not smaller than 0.2 micro-m, due to decrease of the contact resistance of the aluminum powders and the aluminum-oxide powders, electrical conductivity of the electrical-discharge surface-treatment electrode is improved, the electrical discharge becomes stable; therefore, a high aluminum coverage can be ensured.

Here, in this embodiment, although the porosity of the electrical-discharge surface-treatment electrode is set to a constant of 20 volume %, a similar effect can also be obtained in a range from 10 to 50 volume % of the porosity. Moreover, although the average particle diameter of the aluminum powders is set to 1 micro-m, a similar effect can also be obtained by using the aluminum powders whose average particle diameter is not larger than 3 micro-m.

What is claimed is:

1. An electrical-discharge surface-treatment electrode in an electrical-discharge surface-treatment device, comprising:

(A) zinc-based powders including at least one of (i) a pure-metal zinc powder and (ii) a surface-oxidized metal zinc powder generated by the surface of the pure-metal zinc powder being oxidized; and (B) zinc-oxide powders whose concentration ranges from 5 to 90 volume percent given that the total composition of the zinc-based powders (A) and the zinc-oxide powders (B) is 100 volume percent, wherein the zinc-oxide powders (B) have a melting point higher than that of the zinc-based powders (A);

the zinc-based powders (A) and the zinc-oxide powders (B) being compression-molded to obtain a porosity ranging from 10 to 55 volume percent.

2. An electrical-discharge surface-treatment electrode as recited in claim 1, wherein an average particle diameter of the zinc-based powders (B) is not larger than 5 micro-m, and an average particle diameter of the zinc-oxide powders (B) ranges from 0.2 micro-m to 5 micro-m.

3. An electrical-discharge surface-treatment electrode as recited in claim 1, wherein the zinc-oxide powders (B) include at least one of elements selected from a group consisting of aluminum, gallium, and boron.

4. An electrical-discharge surface-treatment electrode comprising:

aluminum-based powders including at least one of a pure-metal aluminum powder and a surface-oxidized aluminum powder generated by the surface of the pure-metal aluminum powder being oxidized; and aluminum-oxide powders whose concentration ranges from 5 to 70 volume percent given that the total composition of the aluminum-based powders and the aluminum-oxide powders is 100 volume percent;

the aluminum-based powders and the aluminum-oxide powders being compression-molded to obtain a porosity ranging from 10 to 50 volume percent.

5. An electrical-discharge surface-treatment electrode as recited in claim 4, wherein an average particle diameter of the aluminum-based powders is not larger than 3 micro-m, and an average particle diameter of the aluminum-oxide powders ranges from 0.2 micro-m to 2 micro-m.

* * * * *